United States Patent [19]

Mahoney

[11] Patent Number: 4,552,089

[45] Date of Patent: Nov. 12, 1985

[54] ROAD WARNING EMERGENCY SYSTEM AND METHOD OF UTILIZING SAME

[76] Inventor: Thomas P. Mahoney, 5 Collins Isle, Balboa Island, Calif. 92662

[21] Appl. No.: 541,875

[22] Filed: Oct. 14, 1983

[51] Int. Cl.[4] ..... G08B 5/00

[52] U.S. Cl. ..... 116/63 P; 116/63 R

[58] Field of Search ..... 40/612; 404/10, 11; 116/63 R, 209, 63 P; 362/145, 160, 253, 812; 340/114 B, 114 R

[56] References Cited

U.S. PATENT DOCUMENTS

| | | | |
|---|---|---|---|
| 3,334,554 | 8/1967 | Adams | 116/63 P |
| 3,879,148 | 4/1975 | Eigenmann | 404/10 |
| 3,996,556 | 12/1976 | Eigenmann | 340/117 |
| 4,080,085 | 3/1978 | Dickson | 404/14 |
| 4,146,635 | 3/1979 | Eigenmann | 404/14 |
| 4,253,415 | 3/1981 | Ferch | 116/63 P |
| 4,515,499 | 5/1985 | Furiate | 404/6 |

FOREIGN PATENT DOCUMENTS

| | | | |
|---|---|---|---|
| 926647 | 10/1947 | France | 116/63 P |
| 1139114 | 6/1957 | France | 116/63 R |
| 522886 | 4/1955 | Italy | 116/63 R |

*Primary Examiner*—Charles Frankfort
*Assistant Examiner*—W. Morris Worth
*Attorney, Agent, or Firm*—Thomas P. Mahoney

[57] ABSTRACT

A road warning system for indicating the presence of emergency or other conditions along a roadway or other surface includes an elongated carrier and a plurality of erectable-retractable warning means which are retracted when the carrier is disposed in a storage mode and erected when the carrier is translated from the storage mode into the utilization mode in which the warning means are erected to indicate the existence of a roadway anomaly. The carrier may consist of a wide variety of different structures, including linkages, continuous lengths of flexible-deformable material and the like. It is also contemplated that the carrier will incorporate various conductors, including electrical and fluid conductors, so that the warning means may be illuminated either electrically or by means of illuminating gases.

8 Claims, 35 Drawing Figures

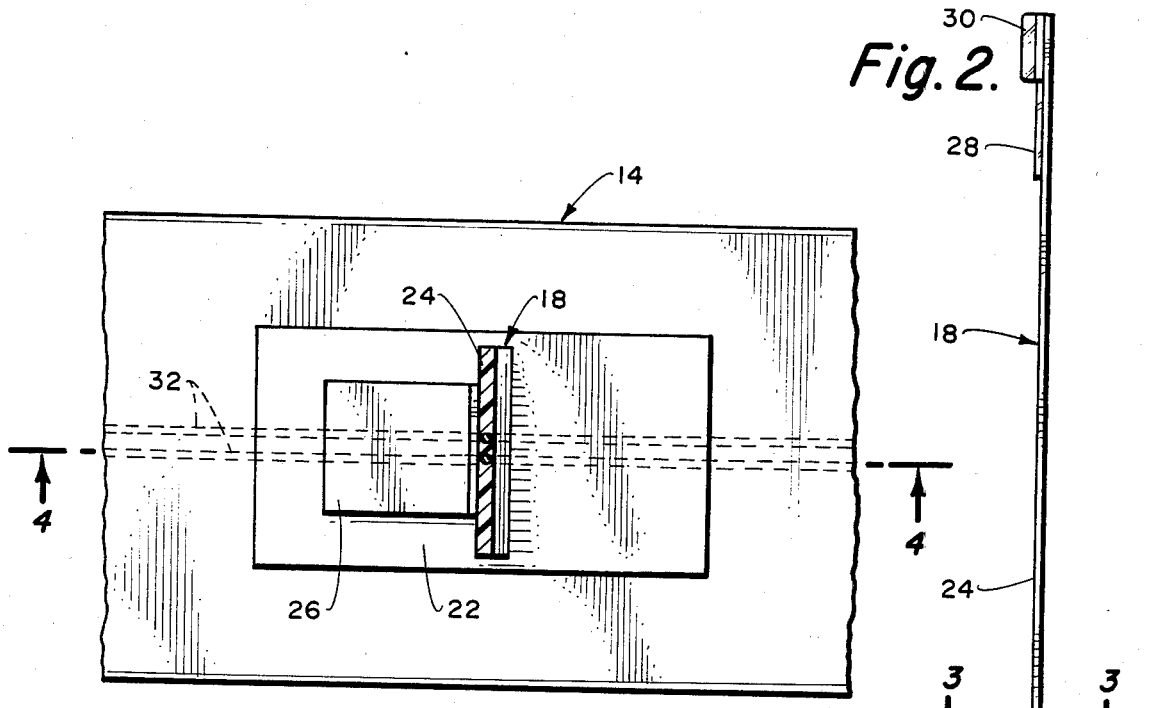
Fig. 3.
Fig. 2.
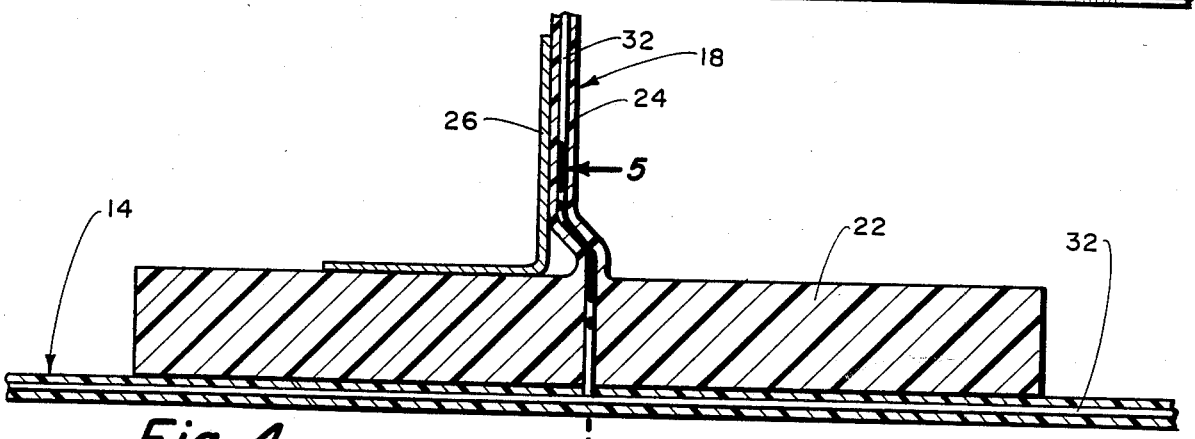
Fig. 4.
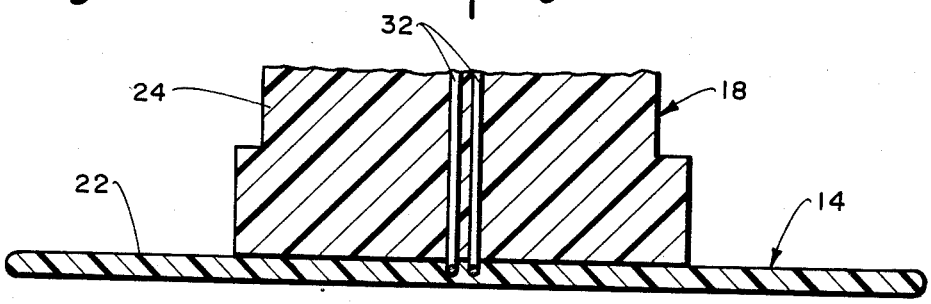
Fig. 5.

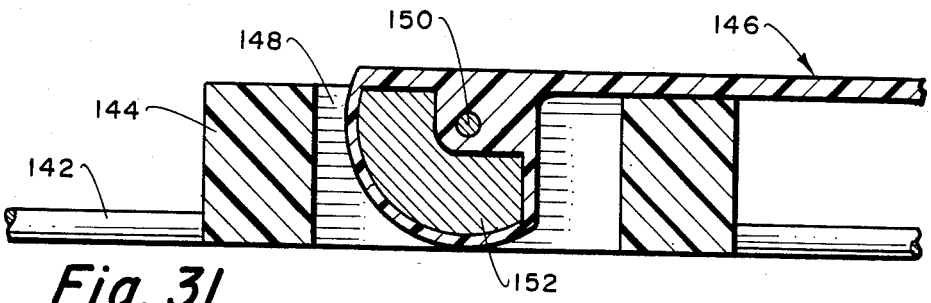
Fig. 31.
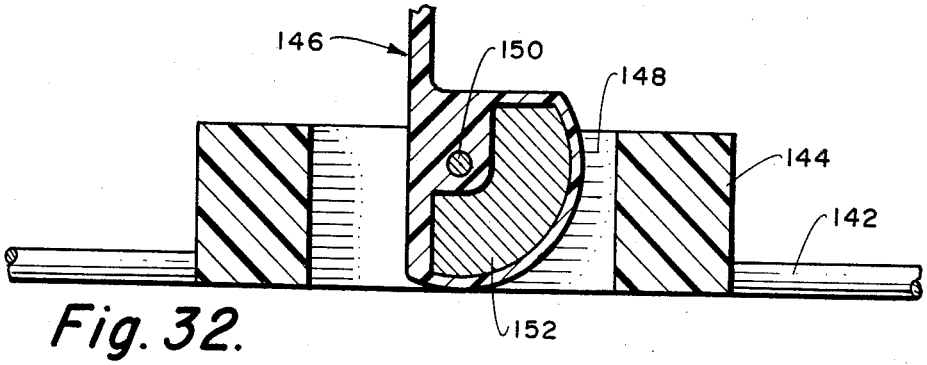
Fig. 32.
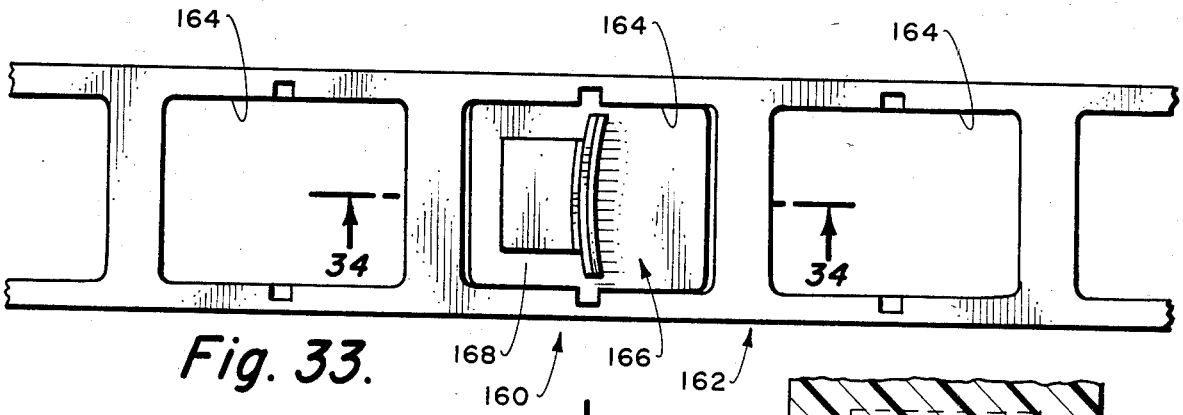
Fig. 33.
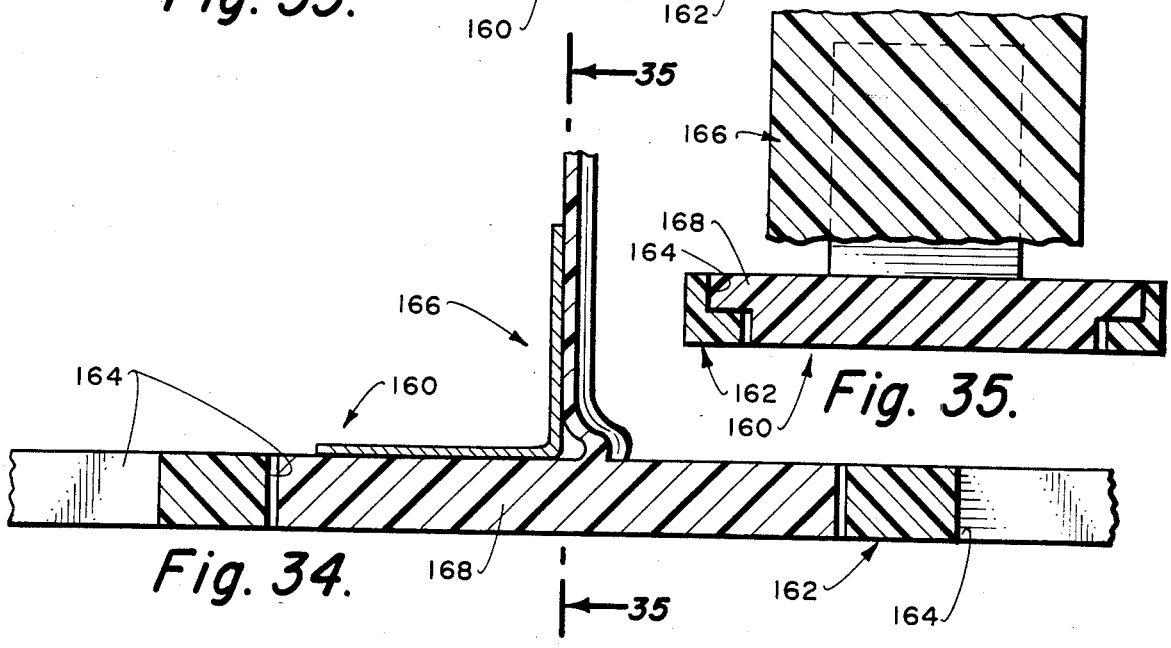
Fig. 35.
Fig. 34.

ROAD WARNING EMERGENCY SYSTEM AND METHOD OF UTILIZING SAME

BACKGROUND OF THE INVENTION

It is well known to those skilled in the art that various types of road warning devices have been developed to cope with the problems incident to the building, maintenance and repair of the extensive highway systems, particularly characteristic of the United States and other developed countries.

Every traveler has observed that, once highways are constructed, they appear to be in a continuous process of repair, modification or refurbishment.

An unfortunate corollary of the intensive development and use of highways systems is the accidents which occur with great frequency and the necessity for blocking off portions of the highway until such accidents can be cleared away.

To cope with the aforesaid problems, various expedients have been developed, including various types of lights, markers and the like.

Most frequently utilized are conical markers which are disposed, sometimes for miles, along a highway section under repair or refurbishment. Also popular are vertical cylindrical markers having weighted bases and reflective elements mounted at their upper extremities.

For nighttime conditions various types of electrically actuated stroboscopic warning lights are provided which are frequently mounted on the primitive, long-utilized sawhorse.

All of the aforesaid devices constitute relatively primitive expedients which have failed to cope adequately with the high technology development incident to the highway systems as they are presently utilized in the United States.

The most objectionable feature of all of the presently utilized expedients is the fact that they are provided as a multiplicity of separate units which must be manually distributed along the section of the highway or other roadway which is being repaired or which must be marked for other reasons. Not only must the various units be placed upon the highway, but they must be recovered therefrom, frequently under hazardous conditions.

Another disadvantage of the presently utilized expedients is the fact that most of them depend upon the incorporation of reflective materials to provide nighttime indication of their location since the provision of electrically energized lights is an expensive proposition.

Inherent in the presently utilized expedients are inventory loss and theft problems. Because the units are separate, they are subject to being misappropriated for various purposes and, when hit by a car or other vehicle, are frequently left at the roadside because the difficulty of recapturing them, with consequent hazard to life and limb, is too great.

Prior art extensible marker cones are shown in U.S. Pat. Nos. 4,197,807 and 4,256,050. A linkage of road warning devices is disclosed in U.S. Pat. No. 3,880,537.

U.S. Pat. No. 3,879,148 discloses a permanently installed tape having road warning devices mounted thereupon and adapted to be deflected by the wheel of a motor vehicle passing thereover.

However, none of these patents discloses the broad concept of an elongated carrier having a plurality of road warning devices mounted thereupon with said carrier being adapted to be moved from a storage mode to a utilization mode in which the road warning devices are displayed on said carrier.

OBJECTS AND ADVANTAGES OF THE INVENTION

It is a primary object of my invention to provide a road warning system which eliminates the utilization of prior art devices and which completely obviates the many disadvantages of such devices. The road warning system of my invention includes an elongated carrier which incorporates a plurality of erectable-retractable road warning means or elements. The carrier is susceptible of being disposed in a storage mode wherein the road warning means or elements are retracted and a utilization mode in which the carrier is payed out from the storage mode into a utilization mode, whereupon the road warning means or devices are erected to provide a visual indication of the roadway anomaly which they are intended to signal to oncoming traffic.

Consequently, the road warning system totally eliminates the time-consuming, expensive and hazardous manual distribution of prior art road warning devices upon the surface of the roadway since the system permits the carrier to be fed from the storage mode without the necessity for the manual handling thereof.

Another object of my invention is the provision of a road warning system of the aforementioned character which includes an elongated carrier which is susceptible of being disposed in a storage mode in a container, or otherwise, on or in a vehicle. The carrier has a plurality of road warning elements thereupon which are capable of being automatically retracted when the carrier is maintained in its storage mode and of being erected or extended when the carrier is payed out upon a roadway surface into its utilization mode.

An additional object of my invention is the provision of a road warning system of the aforementioned character in which the road warning means are automatically extended or erected as the carrier is payed out into its utilization mode.

A further object of my invention is the provision of a road warning system of the aforementioned character in which the carrier can be provided in any desired length dependent upon the materials from which it is constructed and the type of road warning means or device incorporated therein. For instance, it is contemplated that the carrier might consist of a plurality of cables having the road warning means mounted thereupon at selected intervals. The cables are capable of being wound upon a reel as the road warning devices are automatically retracted and unwound therefrom to place the road warning system in its utilization mode.

Other carrier constructions may include elongated webs fabricated from various types of synthetic plastics or may include a plurality of links fabricated from synthetic plastics or other materials.

In any event, it is most desirable that the carrier be capable of being wound or otherwise placed in a compact storage mode from which it can be readily dispensed into the utilization mode.

An ancillary, important advantage of the road warning system of the invention is the provision as a component part of the carrier of various types of conductors intended to convey electrical current, illuminating gases or the like to strobe lights, or gas fittings, to impart to oncoming traffic a continuous nighttime visual indication of the existence of a roadway anomaly.

The electrical conductors and the fluid conduits can be molded into or otherwise formed as part of the carrier of the road warning system and the fluid conduits can also be utilized, in various embodiments of the system, to provide fluid pressure means for causing the movement of the road warning means or devices into the erected position.

A further object of my invention particularly related to the concept of the utilization of various types of conductors to provide for illumination of the road warning devices on the carrier is the utilization of common sources of electrical power, such as generators, or common sources of illuminating gas, such as pressurized containers.

Where pressurized fluid is utilized as a propulsive or erecting means, the utilization of a common compressor for the roadway warning system is contemplated.

While the primary purpose of the roadway warning system is its utilization for extended applications, it is also intended that, as mentioned previously, it be utilized for localized accidents and roadway emergencies, airports, parking lots and the like.

At the present time, there appear to be no adequate means of signalling an accident or roadway emergency to oncoming traffic other than the well-known combustible flares or light-reflective devices.

Since the driving public associates the flare with extreme roadway hazards, it is contemplated that one embodiment of the roadway warning system be provided in the form of an elongated carrier having conduit means therein for conveying ignitable gases to all or selected road warning means incorporated therein. A container of such combustible gases can be provided in the patrol car or other emergency vehicle and the carrier connected thereto by a suitable fitting.

Therefore, an extended carrier can provide ample warning of the existence of an emergency condition rather than the relatively inadequate localized warning imparted by flares, reflective devices, or the like.

After utilization, of course, the roadway warning system mentioned immediately hereinabove can be returned to the storage mode and be ready for subsequent utilizations.

Of course, similar, electrically-energized devices can be provided for the use of truckers and ordinary vehicles and, once again, provide an extended warning not attainable by the use of conventional expedients.

Other objects and advantages of the invention will be apparent from the following specification and the accompanying drawings, a brief description of which appears immediately hereinbelow.

BRIEF DESCRIPTION OF THE DRAWINGS

FIG. 2 is an enlarged, fragmentary side elevational view taken on the line 2 of FIG. 1 and showing the movement of a road warning means from the retracted to the erected position;

FIG. 3 is a top plan view taken from the broken line 3—3 of FIG. 2;

FIG. 4 is an enlarged, fragmentary sectional view taken on the broken line 4—4 of FIG. 3;

FIG. 5 is an enlarged, vertical sectional view taken on the broken line 5—5 of FIG. 4;

FIG. 31 is a vertical sectional view taken on the broken line 31—31 of FIG. 30;

FIG. 32 is a view corresponding to FIG. 31 with a road warning device disposed in the erected position;

FIG. 33 is a top plan view of a portion of another embodiment of the invention;

FIG. 34 is a transverse sectional view taken on the broken line 34—34 of FIG. 33; and FIG. 35 is a vertical sectional view taken on the broken line 35—35 of FIG. 34.

DESCRIPTION OF THE PREFERRED EMBODIMENTS OF THE INVENTION

Figure 1:
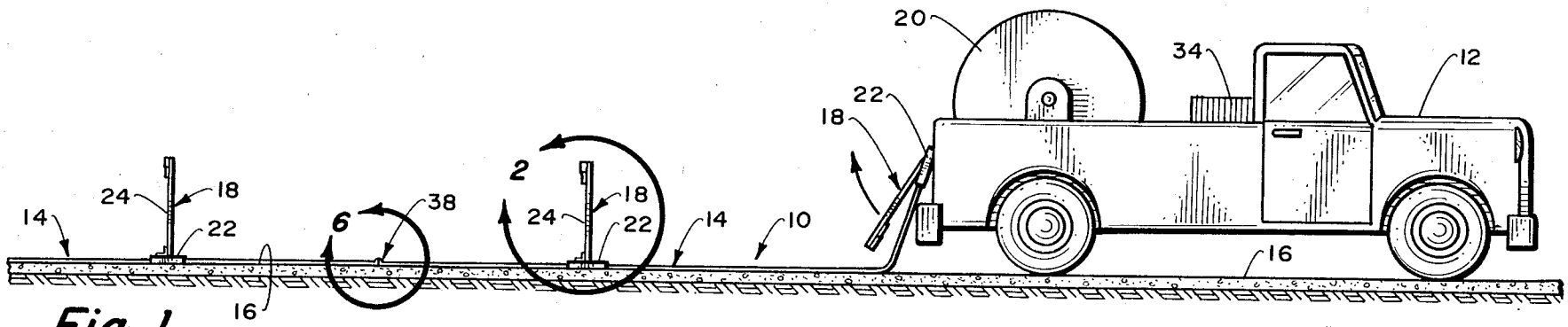
FIG. 1 is a side elevational view showing the road warning system of the invention being dispensed from a vehicle and from the retracted mode to the utilization mode.

Referring to the drawings, and particularly to FIGS. 1–8 thereof, I show a road warning system 10 of the invention being payed out of a vehicle 12 from its storage mode into its utilization mode. The road warning system 10 includes an elongated carrier 14 which, in the utilization mode, engages or is juxtaposed to the surface of a roadway 16 and which has a plurality of erectable-retractable road warning means 18 disposed in spaced relationship on the upper surface thereof to provide a visual indication of a road hazard or other anomalous condition to an oncoming vehicle.

The carrier 14 is constituted by an elongated flexible strip of suitably weather-resistant material which is capable of being moved from the storage to the utilization mode by being payed out of the vehicle 12 from a reel 20 or other storage device. The carrier 14 can be fabricated from a wide variety of flexible materials, including synthetic plastic material such as vinyl, polyethylene, and the like or from plastic impregnated materials such as the fabrics commonly used in inflatable boats or the like. In addition, various other forms of carriers such as cables, cords or the like can be substituted for the plastic carrier.

As in the case of the carrier 14, the road warning devices 18 can be fabricated from a wide spectrum of materials, including the synthetic plastics. For instance, the road warning devices 18 can be injection molded to provide a base 22 and an integral erectable-retractable wand 24 which is adapted to pivot on said base from the retracted, storage mode of the warning system 10 to the erected, utilization mode thereof. To cause the automatic movement of the warning devices, a leaf or other type of spring 26 is interposed between the wand 24 and the base 22 so that the wand 24 will automatically move from the retracted into the erected positions, as graphically shown in FIG. 2 of the drawings.

It is also conceivable that the wand 24 on base 22 be formed of a synthetic plastic wherein the normal memory of the plastic causes the wand 24 to be erected when the warning system 10 is moved from the storage to the utilization modes, thus permitting the erection spring 26 to be eliminated.

In the simplest form of the device, a patch 28 of reflective material is adhered to the upper extremity of the wand, as best shown in FIG. 2 of the drawings.

However, to facilitate the utilization of the road warning system 10 in nocturnal or obscured conditions, strobe lights 30 may be mounted on the upper extremities of the wands in overlying relationship with the reflective patch 28 and conductors 32 are embedded in the carrier 14 to energize the strobe lights 30. Of course, other forms of electrically energized lights may be utilized in substitution for the strobe lights 30.

In any event, the lights 30 may be energized from a generator 34 on the vehicle 12, thus providing a common power source for all of the lights on the wands 24 of the road warning system 10.

It is contemplated that the road warning system be provided in predetermined lengths so that where only a relatively short length of roadway 16 is to be provided with indication of a roadway anomaly, a short length of the road warning system can be deposited in the utilization mode on the roadway surface and power be provided from a source other than the generator 34 on the vehicle 12, such as a small portable generator or a battery pack.

Figure 7:
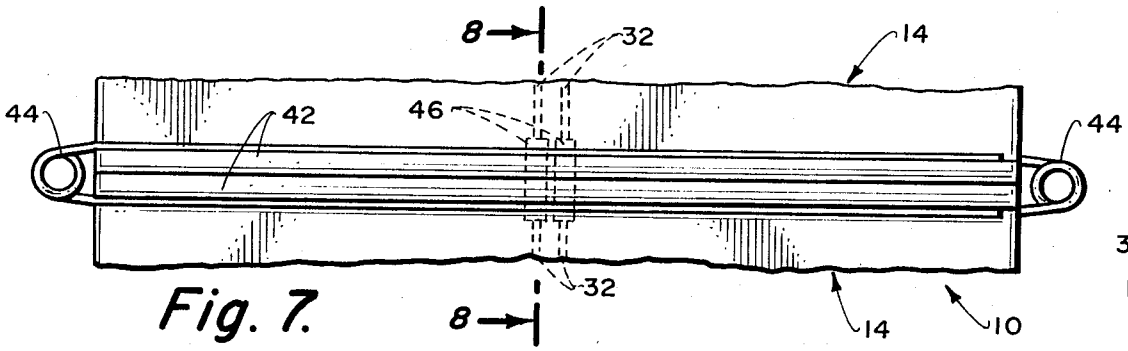
FIG. 7 is an enlarged, fragmentary sectional view taken on the broken line 7—7 of FIG. 6 and showing one version of a securement means between successive lengths of the road warning system.
Figure 8:
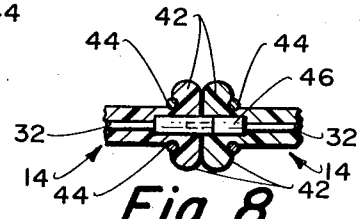
FIG. 8 is a transverse sectional view taken on the broken line 8—8 of FIG. 7 and showing the electrical connection means between the connected lengths of the road warning system.
Figure 10:
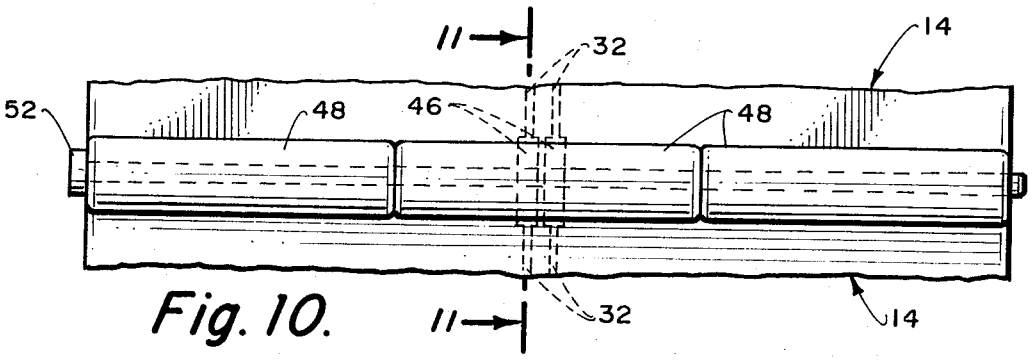
FIG. 10 is an enlarged, fragmentary top plan view taken on the broken line 10—10 of FIG. 9.

The provision of predetermined lengths of carrier 14 and the associated road warning means or devices 18 entails the utilization of linkage means 38, as best shown in FIGS. 1–8 of the drawings. The juxtaposed extremities of the successive lengths of carrier 14 are provided wih integral bosses 42 and spring clips 44 are mounted thereover to maintain the bosses in juxtaposed and operative condition when a relatively long length of the road warning system 10 is to be utilized. Conversely, when a relatively short length is to be utilized, the spring clips 44 are disengaged from the bosses 42 and the respective lengths of carrier 14 separated from each other. In order to insure electrical continuity or discontinuity, elecrical connectors 46 are provided at the abutting surfaces of the carrier 14 lengths, as best shown in FIGS. 7 and 8 of the drawings.

Therefore, it can be readily seen that the flexible carrier 14 can be wound upon the reel 20 to maintain the road warning system 10 in its storage mode. Conversely, the road warning system 10 can be payed out onto the surface of the roadway 16 to dispose the carrier 14 and the road warning devices 18 in the utilization mode.

As the road warning system 10 is payed out onto the surface of the roadway 16, the wands are automatically erected by the associated leaf springs 26. Conversely, when the reel 20 is rotated to cause the withdrawal of the road warning system 10 and the associated carrier 14 thereof into the storage mode, the wands 18 are retracted by being wound about the reel 20.

Although a reel 20 is shown as being utilized for maintaining the road warning system in the storage mode, it is contemplated that various types of storage means may be utilized to reel, stack or otherwise store the road warning system.

In addition, since the road warning system can be provided in predetermined separable lengths, it is conceivable that separable lengths may be utilized by emergency vehicles such as highway patrols for providing advance indication of hazardous conditions and that the lighting circuits for the lights 30 be energized from the vehicle battery. Similar considerations apply with equal cogency to commercial vehicles and to the automobiles of ordinary travelers.

As a matter of fact, to facilitate the use of the road warning system in these applications, a simple plug can be provided below the trunk opening of an automobile, whether emergency, commercial or pleasure, to permit an extremity of the predetermined length of road warning system 10 to be plugged thereinto and to operate from the vehicle battery or a battery pack located in the vehicle.

Figure 11:
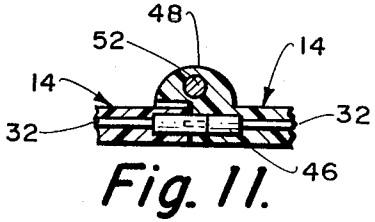
FIG. 11 is a fragmentary sectional view showing an electrical connector at the joint created by the securement or attachment means of FIG. 9.
Figure 6:
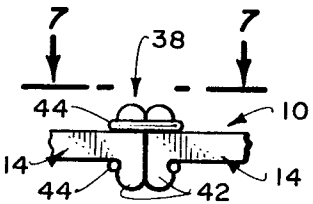
FIG. 6 is a fragmentary side elevational view taken on the line 6 of FIG. 1.
Figure 9:
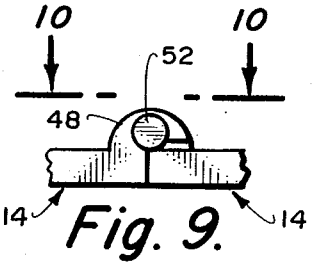
FIG. 9 is a fragmentary view showing an alternative linkage between successive lengths of the road warning system.

Alternative linkage means for maintaining predetermined lengths of the carrier 14 in operative relationship with each other is shown in FIGS. 9 and 11 of the drawings as including hinge knuckles 48 having a disengageable pintle 52 engaged therewith. Therefore, when it is desired to separate the predetermined lengths of carrier 14, the pintle 52 can be removed from operative engagement with the knuckles 48.

In order to insure that the road warning system 10 will maintain its operative relationship with the surface of the roadway 16, the bases 22 of the road warning means can be weighted, thus eliminating the possibility of inadvertent dislodgement of the carrier 14 from engagement with the surface of the roadway 16 by wind conditions or the like.

Figure 12:
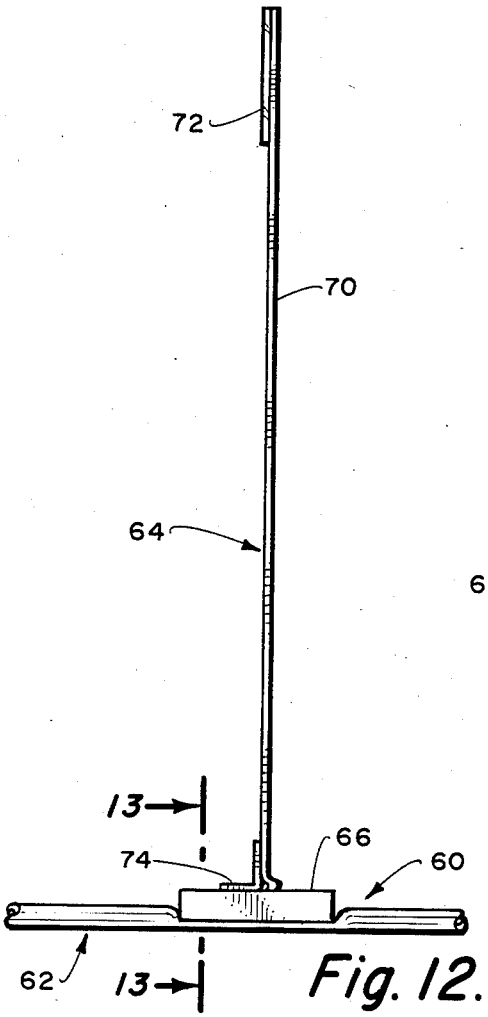
FIG. 12 is a fragmentary side elevational view of an alternative embodiment of the warning system.
Figure 15:
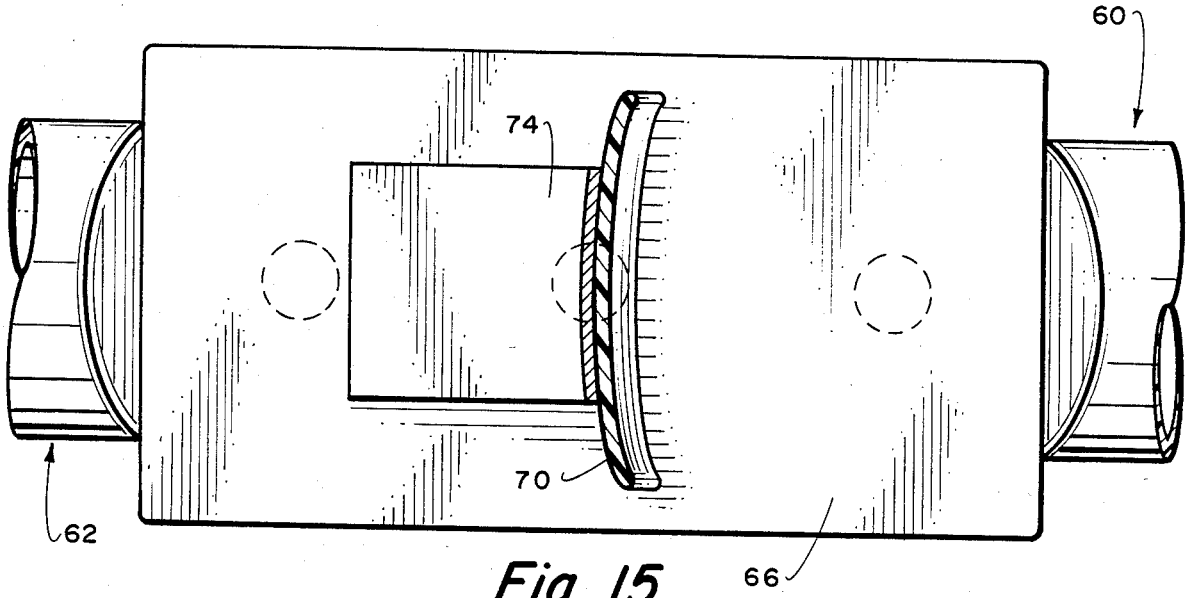
FIG. 15 is a top plan view, partly in section, taken on the broken line 15—15 of FIG. 14.

An alternative embodiment 60 of the invention is shown in FIGS. 12 and 15 as including a carrier 62 formed from a length of tubing fabricated from synthetic vinyl plastic or the like.

Adhered to the tubing at predetermined intervals are road warning means or devices 64. The road warning means or devices 64 include a base 66 having a weight 68 formed from metal, sand, or concrete and having a wand 70 extending upwardly therefrom.

The wand 70 may be fabricated from semi-rigid synthetic plastic materials, such as polyethylene, and may be glued or otherwise adhered to the surface of the base 66. A reflective disk 72 is secured to the upper extremity of the wand 70 and a leaf spring 74 causes the extension or permits the retraction of the wand 70.

Figure 13:
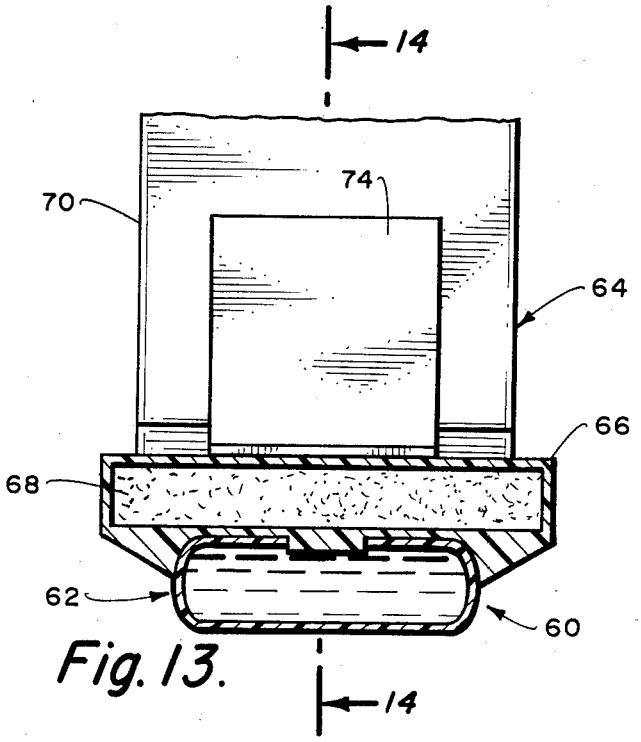
FIG. 13 is an enlarged, fragmentary, partly sectional view taken on the broken line 13—13 of FIG. 12.
Figure 14:
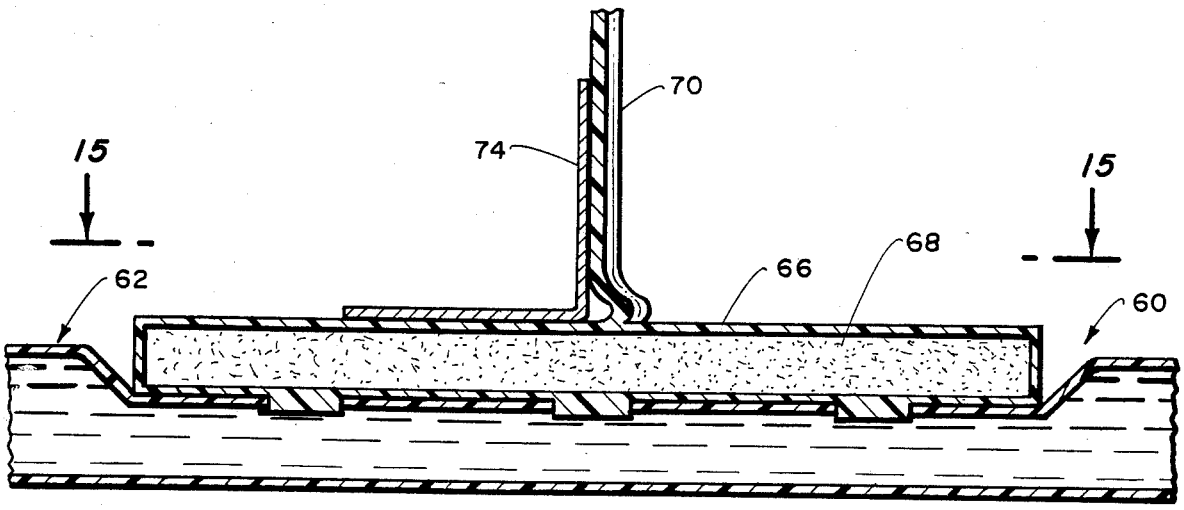
FIG. 14 is a vertical, sectional view taken on the broken line 14—14 of FIG. 13.

In certain applications, the tubing constituting the carrier 62 may be filled with water, as indicated in FIGS. 13–14, to provide additional mass to the road warning system if the weights 68 are not sufficient to maintain the road warning system 60 in operative relationship with the associated roadway.

However, normally, the weights 68 are sufficient to maintain the operative relationship of the road warning system with the associated roadway and the tubing constituting the carrier 62 is permitted to remain in the flat, collapsed condition.

Figure 16:
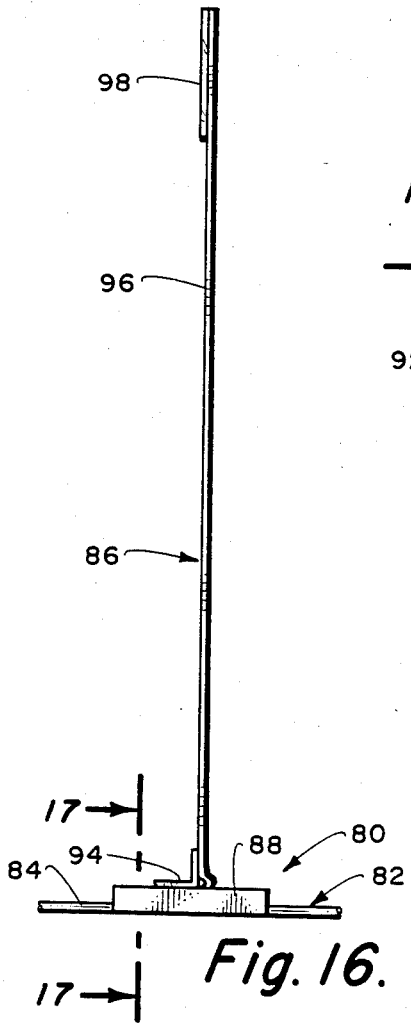
FIG. 16 is a fragmentary, side elevational view of a portion of yet another embodiment of the invention.
Figure 17:
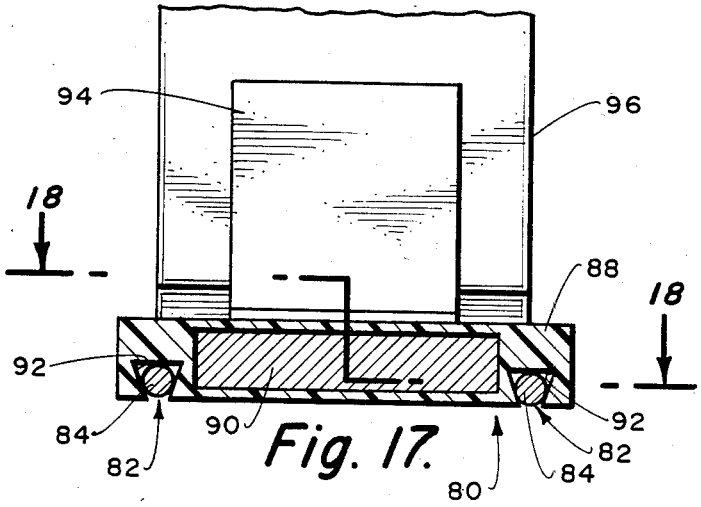
FIG. 17 is a transverse, fragmentary, partly sectional view taken on the broken line 17—17 of FIG. 16.
Figure 18:
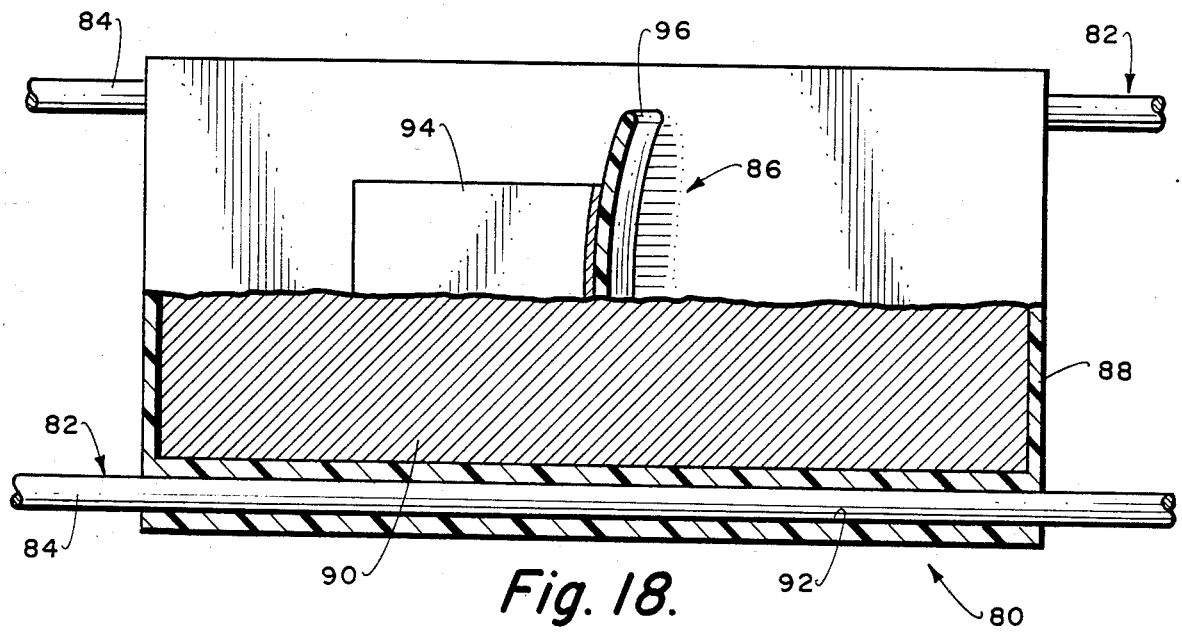
FIG. 18 is a partly sectional, partly elevational view taken from the broken line 18—18 of FIG. 17.

Another embodiment 80 of the road warning system is shown in FIGS. 16–18 of the drawings and includes a carrier 82 constituted by cables 84 arranged in parallelism with each other and adapted to receive unitary road warning means 86. The basic difference between the previously discussed embodiments and the present embodiment of the invention is the unitary nature of the road warning means 86 and the utilization of the cables 84 as the carrier therefor.

Each of the road warning means includes a base 88 fabricated from resilient plastic material such as polyethylene or the like, said base incorporating a weight 90 formed from iron, lead or other materials and having receptor grooves 92 therein which permit the base to be snapped over the cables 84.

Mounted on the base 88 by means of an adhesively or otherwise at fixed spring 94 is an elongated wand 96 which can be fabricated from semi-rigid plastic material, light spring steel or the like and which has a reflective patch 98 at the upper extremity thereof.

One of the advantages of the embodiment of the road warning system 80 of the invention is the fact that the individual road warning means or devices can be located along the length of the cables in any desired spacing pattern, or can be removed therefrom for replacement or can be stripped therefrom for compact storage.

For instance, instead of having the plastic carriers which must be wound or otherwise stored in the storage mode, the cables could be wound separately and compactly into a relatively small size, while the warning devices 86 can be stripped from the cables and stored in a relatively small container.

Therefore, as the cables are payed from the reel or other storage device, the warning devices can be snapped on the cables at the desired intervals.

Of course, the cables can be constituted by conductors and electrical interlock means can be provided between the cables and the warning devices 86 to permit the illumination of a warning light on the upper extremity of the wand 96.

Another embodiment, shown in FIGS. 19–22, consists of a warning device 100 which includes an elongated carrier 102 fabricated from a synthetic plastic and including a plurality of regularly spaced receptacles 104 along the length thereof.

Pivotally mounted on a pin 106 in each or selected ones of the receptacles 104 are road warning devices 108 which are intended to act as laneseparators, rather than indicators of serious roadway anomalies. Torsion springs 110 urge the warning devices 108 into the upper, extended position and reflective patches 112 are secured to the frontal surfaces thereof.

In their normal condition of storage, the road warning devices 108 are retracted by the reeling or other storage mode of the carrier 102 and are automatically moved into the extended position by the torsion springs 110. Consequently, when they are located between the lanes of a roadway or utilized to define emergency lanes, they act as reflectors in the same manner as the fixed reflectors commonly utilized as lane-division indicators.

Figure 19:
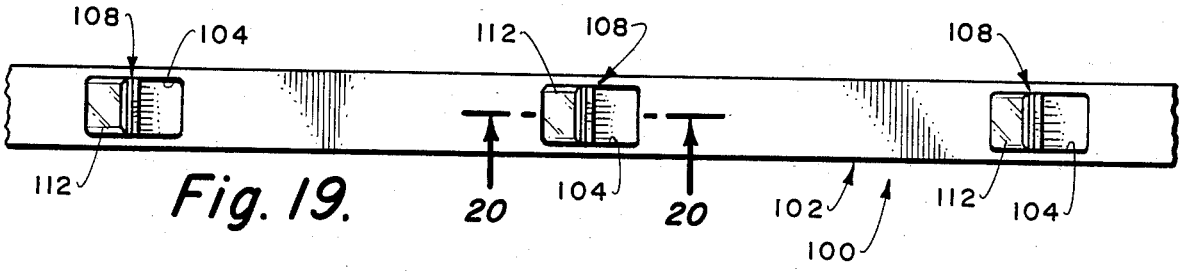
FIG. 19 is a fragmentary top plan view of yet another embodiment of the invention.
Figure 20:
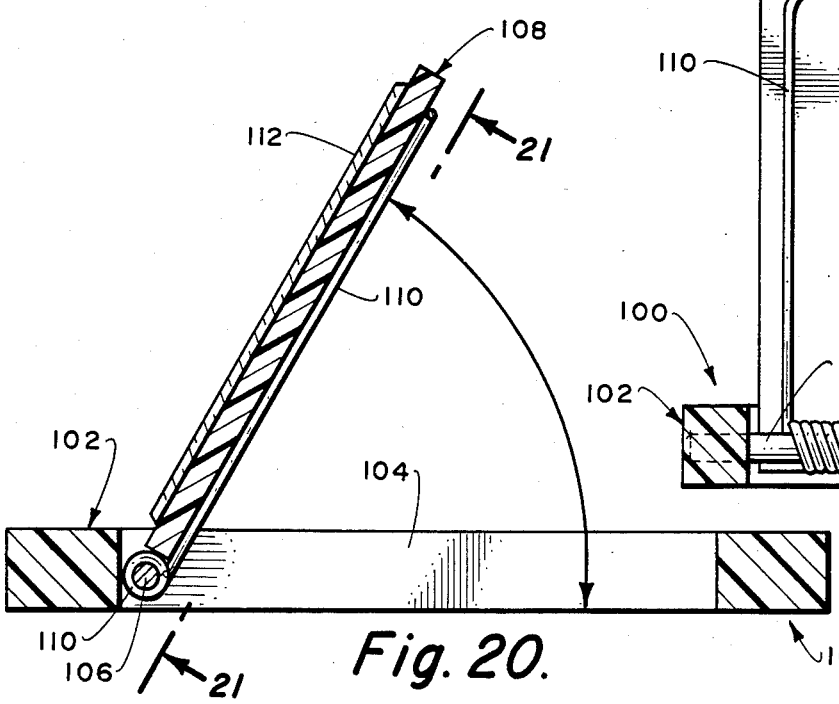
FIG. 20 is an enlarged, fragmentary sectional view taken on the broken line 20—20 of FIG. 19.
Figure 21:
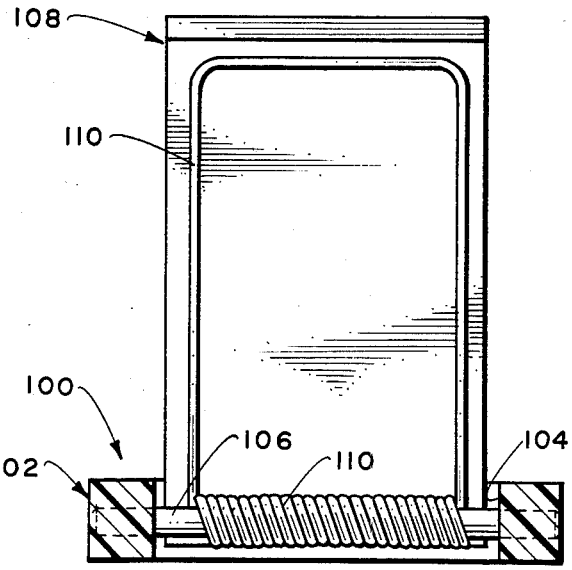
FIG. 21 is a transverse, partly sectional view taken on the broken line 21—21 of FIG. 20.
Figure 22:
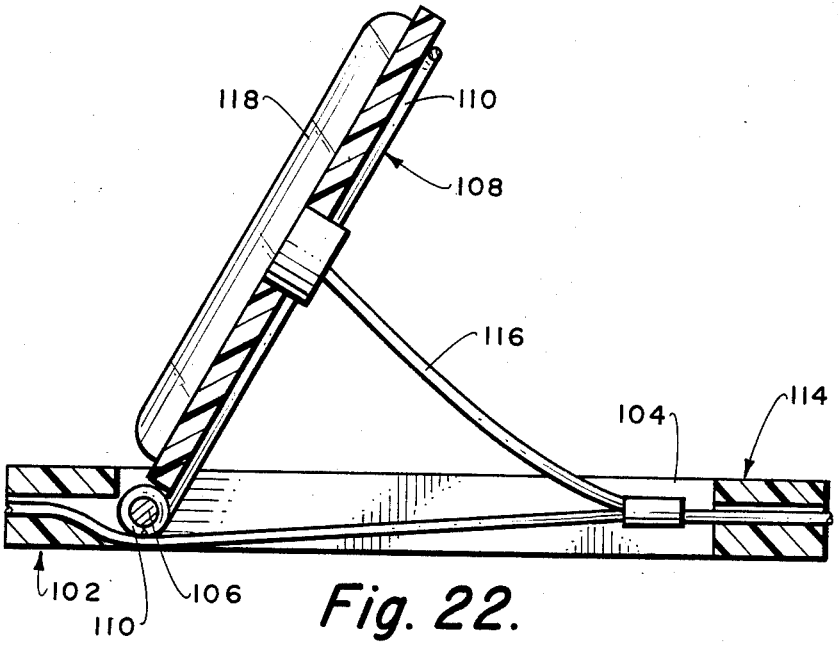
FIG. 22 is an alternative form of the embodiment of the invention shown in FIGS. 19-21, but which is electrically illuminated.
Figure 23:
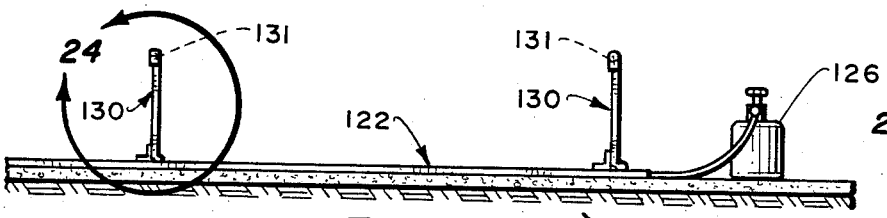
FIG. 23 is a fragmentary, side elevational view of yet another embodiment of the invention.
Figure 24:
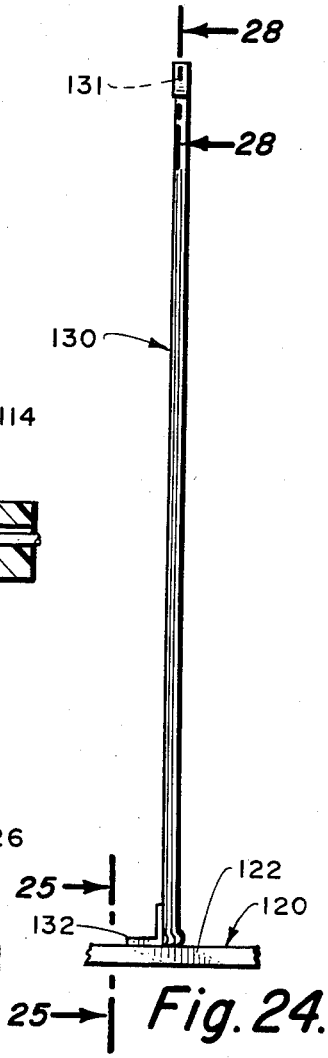
FIG. 24 is an enlarged, fragmentary, side elevational view taken within the line 24 of FIG. 23.
Figure 25:
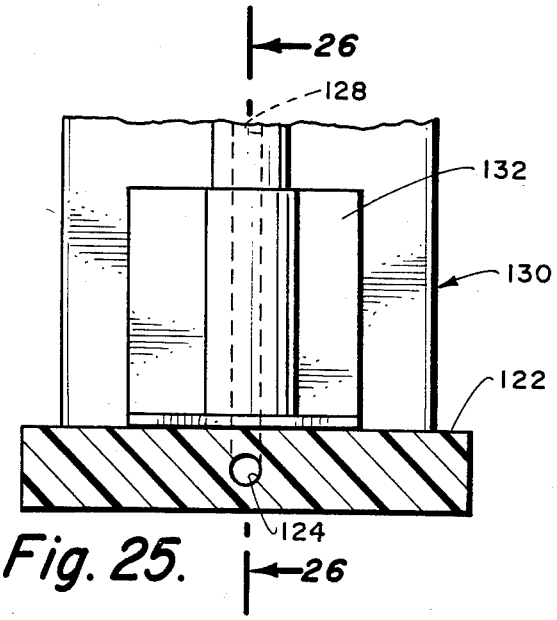
FIG. 25 is an enlarged, fragmentary, partly sectional view taken on the broken line 25—25 of FIG. 24.
Figure 26:
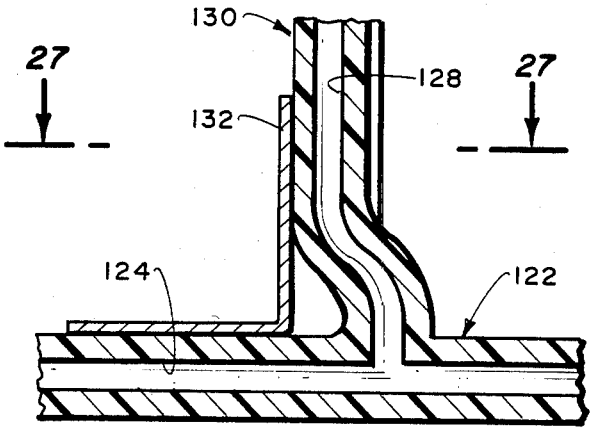
FIG. 26 is a longitudinal, sectional view taken on the broken line 26—26 of FIG. 25.
Figure 27:
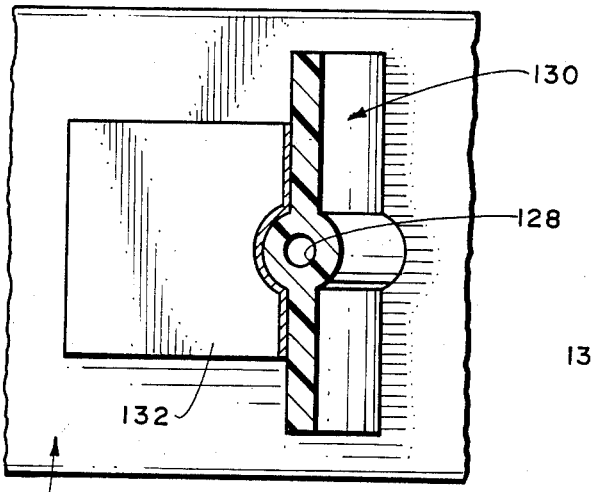
FIG. 27 is a transverse, partly sectional view taken on the broken line 27—27 of FIG. 26.
Figure 28:
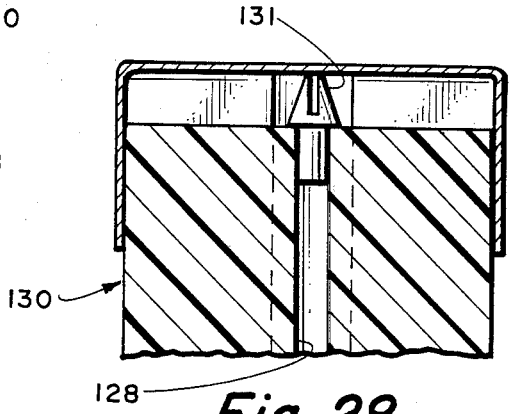
FIG. 28 is a vertical sectional view on the broken line 28—28 of FIG. 24.
Figure 29:
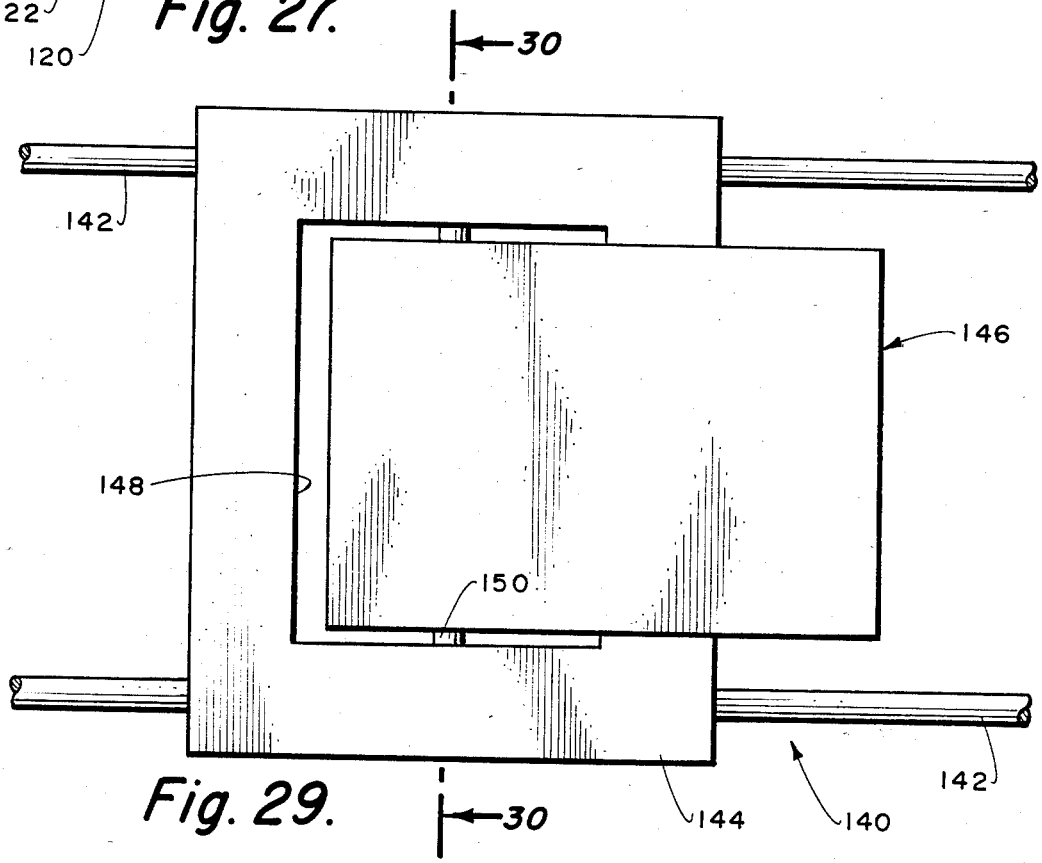
FIG. 29 is a fragmentary top plan view of another embodiment of the invention.
Figure 30:
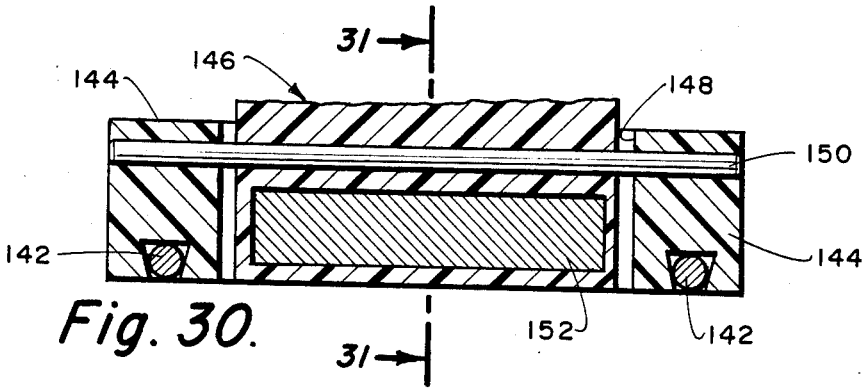
FIG. 30 is a transverse sectional view taken on the broken line 30—30 of FIG. 29.

The road warning system 114 is essentially similar to that road warning system 100 of FIGS. 19–21 with the difference that an electrical conductor 116 is provided which energizes an incandescent lamp 118 on the frontal face of the road warning device 108.

As is well known to those skilled in the art, the traditional flare is used in roadside emergencies and both emergency personnel and vehicles and commercial and pleasure vehicles are frequently equipped with a supply of such flares. Unfortunately, the flares are relatively short-lived and do not provide sufficient advance indication of the emergency which they are intended to signal. However, the average driver has become accustomed to associating the vivid red flare with serious emergencies and the road warning system of the invention illustrated at 120 in FIGS. 23–28 is intended to supplant the conventional flare, while still imparting the visual image of such a flare to the approaching traffic.

An elongated carrier 122 incorporates a preformed conduit 124 for colored illuminating gas which is conveyed thereby from a central container 126 through a communicating channel 128 in the individual road warning device 130. A spring 132 causes the erection of the road warning device 130 and the channel 128 communicates with a conventional gas illuminating nipple 131 located in the upper extremity of the channel 128.

Consequently, it can be readily ascertained that, by the utilization of the embodiment 120 of the invention a verisimilitudinous simulation of the conventional flare may be achieved and the length of the warning system can be as great as desired, since it can be disposed in the utilization mode at a relatively long distance from the scene of the accident or other emergency.

In addition, for use as emergency warning systems in vehicles such as trucks or the like, the road warning system 120 can be carried and connected through a plug with a source of illuminating gas inside the truck or an emergency vehicle, for that matter.

The length of life of the illumination is only determined by the size of the gas storage unit and this can be placed under compression with a suitable pressure regulator which can give ample warning for a prolonged time of a roadway or other emergency.

A road warning system 140 is shown in FIGS. 29–32 and includes carrier cables 142 upon which can be snapped the base 144 of a road warning device 146 in a manner similar to that described in discussing a previously disclosed embodiment of the invention.

In the road warning system 140 the base incorporates a recess 148 and a pin 150 pivotally mounts the road warning device 146 in the recess 148.

Secured to or formed integrally with the lower extremity of the road warning device 146 is a counterweight 152 which causes the road warning device 146 to be automatically swung into the erected position of FIG. 32 when the carrier cables 142 cause the road warning system to be deployed in the utilization mode on an associated roadway or other surface.

The road warning system embodiment 160 of the FIGS. 33–35 includes a carrier 162 formed of synthetic plastic and including a plurality of recesses 164. Individual warning device units 166 have bases 168 frictionally engageable in the recesses 164 so that the units can be installed in any recess in any spacing relationship which is desired. Furthermore, the formation of the carrier 162 in a configuration wherein relatively little material is utilized to define the recesses permits substantial economies in manufacture.

Moreover, the road warning device units 166 can be readily replaced or installed in the recesses so that damaged units or the selected number of units can be removed or installed in the carrier 162.

While I have described numerous preferred embodiments of the invention, it will be apparent to those skilled in the art that alternative forms of the invention are easily conceivable. For instance, the erection of the warning devices may be accomplished by frictional engagement with the roadway surface or by associated cable, pneumatic, spring or other means.

It is not intended that the manufacture of the road warning system and the components thereof be limited to the specific materials suggested, since it will again be obvious to those skilled in the art that a wide variety of alternative materials may be utilized with equal success and achievement of the requisite weather-resistance.

I claim:

1. A reusable road hazard warning system for indicating the existence of hazardous conditions along a roadway or other surface, comprising: an elongated flexible carrier which, when not in use, is stored in a storage mode from which it can be payed out into a utilization mode on said roadway, said carrier conforming to said roadway configuration and irregularities and being disposable in coplanarity with said roadway and unattached thereto; a plurality of road warning elements normally maintained retracted when said carrier is disposed in its storage mode, said road warning elements being attached to said carrier and disposed in contiguity to said carrier in said storage mode, but being erectable therefrom when said carrier is payed out upon said roadway surface into its utilization mode; and an erecting means interposed between said carrier and said road warning elements to cause the automatic erection of said road warning elements as said carrier is payed out on said roadway surface.

2. The system of claim 1 in which said carrier includes detachable linkage means along its length to permit the severance of predetermined lengths of said carrier from the remainder thereof.

3. The system of claim 1 in which said carrier incorporates electrical conductor means and at least certain of said road warning elements include electrically illuminable means connected to said electrical conductor means whereby said road warning elements may provide visual indication of a hazardous condition during obscured or night conditions.

4. The warning system of claim 1 in which said carrier includes a combustible gas conduit and in which at least certain of said road warning means have a combustible gas outlet permitting ignition of said gas to impart a flare-type indication of a hazardous roadway condition.

5. The system of claim 1 in which said carrier includes cable means and said road warning elements are mounted on said carrier cable means at predetermined intervals.

6. The carrier of claim 5 in which said road warning elements are individually removable from said carrier cable means.

7. The road warning system of claim 5 in which said road warning elements may be adjusted along the length of said cable means to permit selective spacing of said road warning elements.

8. The road warning system of claim 1 in which said elongated carrier includes a plurality of receptacles located at predetermined intervals along the length of said carrier and said road warning elements are seperably inserted into said receptacles whereby said road warning elements may be installed in or removed from said receptacles.

* * * * *